US006575003B1

(12) United States Patent
Dupont

(10) Patent No.: US 6,575,003 B1
(45) Date of Patent: Jun. 10, 2003

(54) DOOR LOCK FOR A VEHICLE WITH ELECTRICAL LOCKING/UNLOCKING

(75) Inventor: Patrick Dupont, Noyelles/Mer (FR)

(73) Assignee: Valeo Securite Habitacle, Creteil Cedex (FR)

( * ) Notice: Subject to any disclaimer, the term of this patent is extended or adjusted under 35 U.S.C. 154(b) by 0 days.

(21) Appl. No.: 09/436,802

(22) Filed: Nov. 9, 1999

(30) Foreign Application Priority Data

Nov. 9, 1998 (FR) ..... 98 14062

(51) Int. Cl.[7] ..... E05B 47/04

(52) U.S. Cl. ..... 70/257; 70/264; 70/278.7; 70/279.1; 292/201; 292/DIG. 27

(58) Field of Search ..... 70/257, 264, 277, 70/278.7, 279.1, 278.6; 292/201, DIG. 27

(56) References Cited

U.S. PATENT DOCUMENTS

| | | | | | |
|---|---|---|---|---|---|
| 1,833,572 | A | * | 11/1931 | Hardesty | 70/283 |
| 5,054,300 | A | * | 10/1991 | Nakahara et al. | 70/264 X |
| 5,497,641 | A | * | 3/1996 | Linde et al. | 70/257 |
| 5,682,135 | A | | 10/1997 | Labonde | 340/426 |
| 5,722,272 | A | * | 3/1998 | Bridgeman et al. | 70/264 |
| 5,844,470 | A | | 12/1998 | Garnault et al. | 340/426 |
| 5,887,466 | A | * | 3/1999 | Yoshizawa | 70/257 |
| 6,002,341 | A | * | 12/1999 | Ohta et al. | 307/10.2 X |
| 6,065,316 | A | * | 5/2000 | Sato et al. | 70/264 |
| 6,364,378 | B1 | * | 4/2002 | Humbert et al. | 392/216 X |
| 6,367,296 | B1 | * | 4/2002 | Dupont | 70/257 |

FOREIGN PATENT DOCUMENTS

| | | |
|---|---|---|
| DE | 42 28 233 | 3/1994 |
| DE | 44 35 894 | 4/1996 |
| EP | 0 812 972 | 12/1997 |
| EP | 0 816 597 | 1/1998 |
| FR | 2 674 895 | 10/1992 |
| FR | 2 775 016 | 8/1999 |

* cited by examiner

*Primary Examiner*—Lloyd A. Gall
(74) *Attorney, Agent, or Firm*—Morgan & Finnegan, LLP

(57) ABSTRACT

An automatic lock for a vehicle door includes a latch bolt and a retractable pawl that maintains the latch bolt in the closed position. The lock also includes a latch bolt release member having a controller which may be actuated in response to operation of a door handle and when the lock is unlocked can retract the pawl. An electronic recognition member produces an unlocking signal in response to a predetermined identification signal. A first electric actuator is responsive to the unlocking signal to unlock the lock. A second electric actuator is responsive to the unlocking signal for releasing the latch bolt.

20 Claims, 1 Drawing Sheet

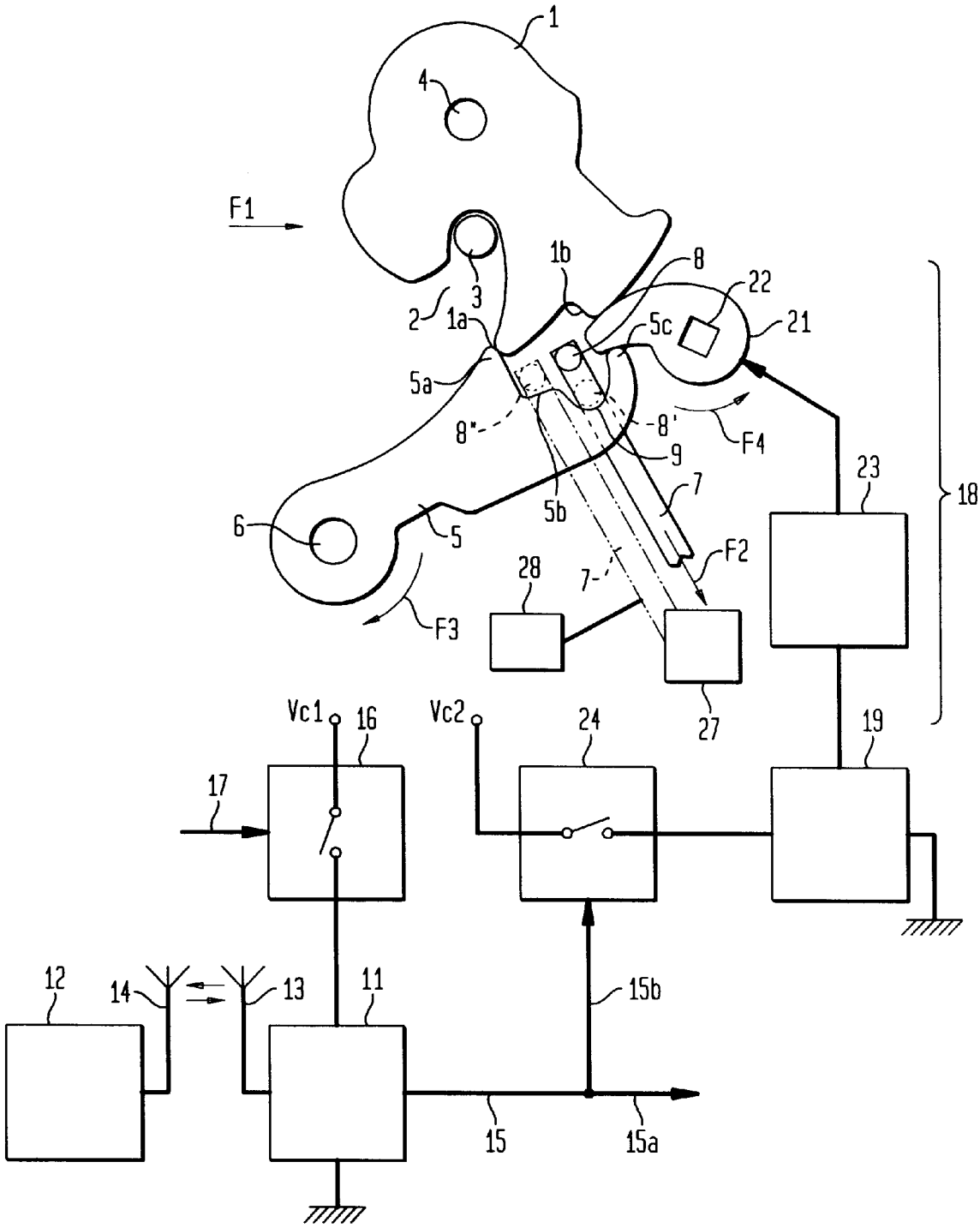
1
4
F1
3
2
1a
1b
8
22
21
5c
5a
8"
8'
9
F4
23
18
7
5b
6
5
F2
28
7'
F3
27
Vc1
16
Vc2
24
19
17
12
14
13
11
15b
15
15a

DOOR LOCK FOR A VEHICLE WITH ELECTRICAL LOCKING/UNLOCKING

BACKGROUND OF THE INVENTION

This invention relates to door locks for a vehicle, and particularly locks with electrical locking and unlocking.

This type of lock comprises a forked latch bolt in a known manner designed to cooperate with a striker, a pawl that normally holds the latch bolt in the closed position, a latch bolt release mechanism comprising a control device to which an actuating movement is applied when the user operates the corresponding vehicle door handle. The control device may be in an active position during which it acts on the pawl during actuating movement to put the pawl in a "retracted" position (in which said pawl frees the latch bolt), and an inactive position in which said control device has no effect on said pawl during its actuating movement. The lock also comprises an electromechanical locking/unlocking system that responds to at least one unlocking signal by moving said control device from its inactive position to its active position.

Vehicle door closing systems are known in which the unlocking signal is generated by activating a lock barrel. In other known systems, this unlocking signal is generated by an electronic recognition device in response to an infrared remote control signal or a radio-electric remote control signal produced by the user operating an appropriate remote control. With these known systems, if the lock is in the locked state, in other words if the control device that forms part of the latch bolt release mechanism is in its inactive position, two successive actions are then necessary to open the door; first, the lock needs to be released using appropriate means (key, remote control, etc.), and then the door has to be opened, for example by pulling on its outside handle.

Obviously, when the vehicle is used frequently, it is inconvenient to be obliged always to carry out two actions to unlock then unfasten the door in order to enter the vehicle. Furthermore, this could also be seen as a nuisance to the extent that these known systems require the use of either a key or a remote control which occupies one of the user's hands.

This is why so-called "hands-off access" systems have already been proposed, designed to enable a user to open a vehicle door directly by a single action on the outside handle of the corresponding door, regardless of whether said door lock is in the locked or unlocked state, without the need for a key, remote control or any similar device in order to unlock the door. In these known systems, this is done by the use of an electronic recognition device equipped with a radio transmitter designed to communicate with a radio-electric device called an "electronic identifier", built into a watch, credit card, badge or similar device worn or carried by the user. The electronic recognition device does not produce its unlocking signal until the right owner has been identified.

In this type of known "hands-off access" system, an unlocking signal controlling the electromechanical locking/unlocking device is emitted at the same time as the release mechanism is actuated. The difference between the relatively long response time of the electromechanical device and the relatively short response time of the release mechanism is such that said control device which forms part of the latch bolt release mechanism has frequently terminated its activation movement although the electromechanical locking/unlocking device has still not put the control device in the active position. The result is that the first time that the user operates the door handle does not open the door, and he must operate the door handle again to open the door. The fact that the door handle has to be pressed twice is obviously a disadvantage for a system which is intended to open the door in a single operation.

French patent application No. 98 05604 submitted on May 4, 1998 provides two solutions for overcoming this disadvantage. These two solutions consist of using an opening compensation means which brings the pawl into its "retracted" position, if an unlocking signal is sent substantially at the end of the control device actuating movement. Specifically, in both of these two known solutions, the control device that acts on the pawl to move it into its "retracted" position or an actuation lever which also forms part of the latch bolt release mechanism, is shaped so that part of its surface is in the shape of a ramp at an angle to the direction of movement of the control device. At the end of the movement actuating said control device, the shaped part acts directly or indirectly depending on solution mentioned above, like a cam on the pawl to move it into its "retracted" position.

BRIEF SUMMARY OF THE INVENTION

The purpose of this invention is to provide a solution that avoids the need for the user to exert two actions on the door handle in order to open it.

Consequently, the invention relates to an electrical locking/unlocking lock for a vehicle door, with hands-off access, comprising:

a) a forked latch bolt which cooperates with a striker, b) a pawl that blocks the latch bolt in the closed position and which can be moved into a "retracted" position in which it no longer acts on the latch bolt, c) a latch bolt release mechanism comprising a control device which may be actuated in response to a user operating said door handle and which, in the unlocked state of the lock, can act on the pawl during its actuating movement to bring it into said "retracted" position, d) an electromechanical locking/unlocking device including an electric actuating device that reacts to at least one unlocking signal to put the lock into said unlocked state, e) an electronic recognition device capable of producing said unlocking signal when it recognizes an appropriate electronic identifying device worn or carried by the vehicle owner or by an authorized user;

and an electromechanical latch bolt release device comprising another electric actuating device that reacts to said unlocking signal by acting directly on the pawl or on a part associated with the pawl, which is distinct from the parts of said release mechanism and said electromechanical locking/unlocking device, to put said pawl into its "retracted" position.

Under these conditions, given that two distinct electric drive devices are provided, a first electric drive device for locking/unlocking the lock and a second electric drive device to release the latch bolt, both of which react to the unlocking signal, the first electric actuating device, composed for example of an electromagnet or an electric motor, may be small and of low power since all it has to do is bring the pawl into its "retracted" position to release the latch bolt. The second electric actuating device, which for example may be composed of an electric motor associated with a set of reduction gears, may also be compact and of low power since it no longer needs to unlock the lock and release the latch bolt, but simply has to release the latch bolt by putting the pawl into its "retracted" position. Note also that if there is a mechanical and/or electrical failure of the electromechanical locking/unlocking device or its electrical actuating device, even if the lock remained in a locked state, the latch bolt can still be released and the vehicle door may be opened using the electronic recognition device and the second electrical actuating device that acts directly on the lock pawl to put the lock pawl into its "retracted" position without using the normal movement control systems in the release mechanism and/or the electromechanical locking/unlocking device.

Preferably, according to one possible embodiment of the invention, the electromechanical release device comprises an electric motor that acts on a drive which acts in turn on the pawl to put it into the "retracted" position in response to the unlocking signal.

The electrical power supply for the motor may pass through a normally open switch, which is closed in response to a transmitted unlocking signal, this switch closing an electric power supply circuit to the motor.

Preferably, the electronic recognition device only receives an electric power supply when the user exerts an opening action on the door handle. This thus avoids the electronic recognition device being permanently powered and pointlessly consuming energy.

Consequently, the electrical power supply to the electronic recognition device may be applied by a control system such as a normally open microswitch, which is closed under the control of said opening action exerted on the door handle. This microswitch closes an electric power supply circuit to the electronic recognition device.

BRIEF DESCRIPTION OF THE DRAWING

Other characteristics and advantages of the invention will become evident on reading the description below of a preferred embodiment of the lock according to the invention, given only as a non-limitative example, with reference to the single attached FIGURE which shows said lock partly in elevation and partly in the form of a functional diagram.

DETAILED DESCRIPTION OF THE INVENTION

With reference to the single FIGURE in the attached drawing, it can be seen that the lock comprises a forked latch bolt 1, in which the fork delimits recess 2 substantially in the shape of a V, which is designed to receive a striker 3 that cooperates with the lock. In a known manner, the striker 3 may be composed of a stud that projects from a fixed pillar of a vehicle door facing the lock on said door.

Relative movement of the door with respect to the door pillar, when closing the door, corresponds to a relative movement of the striker 3 along the direction shown by arrow F1 in the FIGURE.

The latch bolt 1 can rotate about an axis 4 and, in the closed state of the lock, it cooperates with a pawl 5 which can rotate around a pin 6. The pawl 5 is subjected to an elastic return force that pushes it towards latch bolt 1. This elastic return force may be provided by a spring (not shown), for example a torsion spring mounted on the pin 6.

When the door is closed, the latch bolt 1 is pushed against an elastic return force that acts to return the latch bolt to the position in which it is located in the FIGURE, pawl 5 in contact through its nose 5*a* with a notch 1*a* formed in the latch bolt 1. Consequently, latch bolt 1 is kept in the position shown in the figure and the striker 3 is trapped in recess 2, which keeps the door in the closed state.

In a known manner, the latch bolt 1 may comprise a second notch 1*b* which corresponds to a slightly open but locked position of the door, in which this notch cooperates with nose 5*a* of pawl 5.

The lock also comprises a release mechanism which, under certain conditions described later, releases the latch bolt 1 by putting the pawl 5 into a "retracted" position in which it no longer blocks the latch bolt 1 and therefore enables the door to be opened. This mechanism, which is only partially shown in the FIGURE, comprises a control device 7 which is mechanically linked to the door handle 28 in a known manner, so that it can be activated by the user pulling on the handle, more precisely, a moving arm of the handle. In the embodiment shown in the FIGURE, the control device 7 is composed of a rod 7, the upper end of which is fitted with a pin 8 that projects on one side of the rod 7, so that under some conditions, the pin can come into contact with the pawl 5. Arrow F2 shows the direction of displacement of the control rod 7 when the user pulls on the door handle.

The lock according to the invention also includes an electromechanical locking/unlocking device, in a known manner, comprising an electric actuating device 27 which puts the lock selectively either in a locked state or in an unlocked state. This-electric actuating device may be composed of an electromagnet or an electric motor that is coupled to the control rod 7 in a known manner to selectively put the control rod into either the position represented by a solid line in the FIGURE, which corresponds to the lock in the locked state, or into the position represented by a chain-dotted line in the FIGURE, which corresponds to the lock in the unlocked state.

In the locked state of the lock, the pin 8 on the control rod 7 is facing a notch 9 formed in the pawl 5. The depth of this notch 9 is such that, when the rod 7 has reached the limit of its travel, the pin 8 has not reached to the bottom of the notch 9. This state of the pin 8 is shown as 8' in the FIGURE. Under these conditions, actuating the control rod 7 in response to the door handle being operated has no effect on the pawl 5 and the lock remains locked, such that the door cannot be opened.

In the unlocked state of the lock, the pin 8 is in the position shown as 8" in the FIGURE, in which it is in the immediate vicinity of a portion of a contact surface 5*b* of pawl 5. Under these conditions, as soon as the control rod 7 starts to move along the direction of arrow F2 in response to the door handle being actuated, the pin 8 acts on the pawl 5 to rotate the pawl in the direction of arrow F3, which has the effect of releasing latch bolt 1 so that the door can be open.

In order to enable hands-off access to the vehicle, in other words to enable the user to open his vehicle door by a single action on the door handle without the need to use a key or a remote control to previously release the lock if it was in the locked state, an electronic recognition device 11 is associated with the lock to put it into an unlocked state when it recognizes an appropriate electronic identifying device 12 carried or worn by the vehicle owner or by an authorized user. This electronic recognition device 11 comprises a radio transmitter equipped with an antenna 13 in a known manner. The antenna may be located in the door handle, and communicates using an appropriate predefined protocol, via an antenna 14 with the electronic identifying device 12. This device 12 may be built into a watch or a card or a badge worn or carried by the user, in a known manner.

When the electronic recognition device 11 recognizes the right owner or an authorized user, it emits an unlocking signal on its output 15 which is sent through line 15*a* to the electromechanical locking/unlocking device described above, in order to unlock the lock. For example, in the embodiment shown in the FIGURE, the electromagnet or the electric motor in the electromechanical locking/unlocking device is activated in response to the unlocking signal present on line 15*a,* in order to move the control rod 7 from the position shown as a solid line to the position shown as a chain dotted line.

Usually, emission of the unlocking signal simultaneously, or almost simultaneously, controls firstly the electrical device (electromagnet or electric motor) in the electromechanical locking/unlocking device, and secondly activates the latch bolt release mechanism. In other words, the unlocking signal activates the door handle and subsequently activates the control rod 7. This is particularly true when the electronic recognition device 11 is only supplied with electric power when the user operates the door handle to open the door, in order to prevent unnecessary consumption of electrical energy. As shown in the FIGURE, the electronic recognition device 11 is electrically connected to a DC voltage source Vc1, for example through a micro-switch 16, which is normally open and may be closed in response to said action on the door handle, as symbolized by arrow 17.

Since the total time taken by the electronic recognition device 11 to communicate with the device 12, to identify the right owner and to emit the unlocking signal, plus the time taken by the electromechanical locking/unlocking device to move the control rod 7 from its position corresponding to the locked state to its position corresponding to the unlocked state, in response to the transmission of the unlocking signal, is longer than the response time of the release mechanism of the latch bolt 1, (i.e., the time taken by the control rod 7 to complete its movement in response to actuation of the door handle), the control rod 7 has usually finished its actuating movement although it is not yet in its position corresponding to the unlocked state of the lock (i.e., position in which pin 8 on said rod 7 is in position 8" facing the contact surface 5*b* of pawl 5). Under these prior art conditions, despite transmission of the unlocking signal, pin 8 in the control rod 7 engages notch 9 of pawl 5, such that the actuating movement of the control rod has no effect or practically no effect on this pawl.

In order to overcome this problem of the prior art, this invention proposes to add an electromechanical release device 18 for latch bolt 1 which, in response to transmission of an unlocking signal emitted by the electronic recognition device 11, acts on pawl 5 directly. In other words without passing through any of the elements of the latch bolt release mechanism or the electromechanical locking/unlocking device described above, the electromechanical release device rotates the pawl 5 in the direction of arrow F3 around pin 6 and thus release the latch bolt 1 regardless of the state of the lock (locked or unlocked).

In the embodiment shown in the FIGURE, the electromechanical device 18 releasing the latch bolt 1 comprises an electrical drive control unit 19, for example an electric motor which, when it is started up by said unlocking signal, acts on a pusher 21 fixed in rotation about a pin 22, to rotate the pusher by a limited angle in the direction of the arrow F4. As it rotates in the direction of arrow F4, the pusher 21 in turn moves a projection 5*c* of pawl 5 in order to rotate it in the direction of arrow F3 about pin 6 and thus release the latch bolt 1.

In one embodiment of the invention, the electric motor 19 may be a reversible motor, in other words a motor with two directions of rotation, in which case its output shaft may be connected directly, or preferably connected through a set of reduction gears, to pin (i.e., spindle) 22 of the pusher 21.

In another embodiment of the invention, the electric motor 19 is a motor with a single direction of rotation, and in this case its output shaft is connected to spindle 22 of pusher 21 through a motion control system 23 shown diagrammatically by a box in the FIGURE. This drive system 23 may comprise a set of reduction gears driving a disk fitted with at least one crank pin, and preferably two crank pins placed 180° from each other on a surface of the disk, and a swinging lever that may be actuated by the crank pin or one of the two crank pins of the disk during each operating cycle. The drive system is fixed on pin 22 of the pusher 21 so that it is fixed in rotation. For example, this type of motion control system is described in French patent application FR-98 02001 filed on Feb. 19, 1998, or in document EP-A-0 812 972 (FIGS. 8–14).

Although the electric motor in the systems described in the two documents cited above is powered and started by a switch controlled by the door handle, in the lock according to the invention the electric motor 19 is electrically connected to a DC voltage source Vc2 through a switch 24, for example a relay or an electronic switch which is normally open and which is closed in response to the unlocking signal. The unlocking signal is sent to switch 24 through a line 15*b* connected to the output 15 from the electronic recognition device 11.

In addition to switch 24, other position sensors and/or limit switch detectors such as micro-switches may be provided in a known manner to manage operation of the electric motor 19, and in particular the stopping of the motor or operation of the motor in several phases, as described in the documents mentioned above.

Therefore, with the lock described above, it can be seen that the latch bolt 1 can be released in a positive manner by a single action on the vehicle door handle in response to transmission of the unlocking signal produced by the electronic recognition device 11, regardless of the locked or released state of the lock.

If the vehicle is equipped with a central locking/unlocking system, the unlocking signal emitted on line 15*a* may also be used to release the locks on the other doors or windows of the vehicle.

It is clear that the embodiment of the invention that was described above is given purely as an example and is in no way restrictive, and a professional of the art could make many modifications while remaining within the scope of the invention. In particular, the latch bolt release mechanism (control rod 7) and the electromechanical locking/unlocking device could be made in any other known manner. Furthermore, the pusher controlled by the electric motor 19 could be fitted on the same spindle 6 as the pawl 5 so that it is fixed to it in rotation, as described and shown in FIGS. 1 to 7 in the above-mentioned document EP-A-0812972.

What is claimed is:

1. An electrical locking/unlocking lock for a vehicle door, with hands-off access and having a locked state and an unlocked state, the lock comprising:

a) a forked latch bolt which cooperates with a striker, b) a pawl that blocks the latch bolt in a closed position and that can be moved into a "retracted" position in which the pawl no longer acts on the latch bolt, c) a first latch bolt release mechanism comprising a control device which may be actuated in response to a user actuating a door handle and which, in the unlocked state of the lock, acts on the pawl during the release mechanism's actuating movement to bring the pawl into said "retracted" position, d) an electromechanical locking/unlocking device including a first electric actuating device that reacts to at least one unlocking signal to put the lock into said unlocked state, e) an electronic recognition device capable of producing said unlocking signal when recognizing an identification signal from a hands-off electronic identifying device, and f) a second latch bolt release mechanism which is electromechanical, the second latch bolt release mechanism comprising a second electric actuating device that reacts to said unlocking signal by acting on the pawl to put said pawl into said "retracted" position.

2. A lock according to claim 1, wherein the second latch bolt release mechanism comprises an electric motor and a pusher connected to said motor, said pusher acting in turn on the pawl and placing the pawl into the "retracted" position in response to the unlocking signal.

3. A lock according to claim 2 further including a normally open switch, wherein an electrical power supply for the motor passes via said normally open switch, said normally open switch closed in response to the unlocking signal, said normally open switch closing an electric power supply circuit to the motor.

4. A lock according to claim 1, wherein the electronic recognition device only receives an electric power supply when the user exerts an opening action on the door handle.

5. A lock according to claim 4 further including a normally open microswitch, wherein the electric power supply to the electronic recognition device is provided through said normally open microswitch, said normally open microswitch closed in response to said opening action exerted on the door handle, said normally open microswitch closing an electric power supply circuit to the electronic recognition device.

6. An automatic lock assembly for a door comprising a latch bolt, said latch bolt being movable between a closed position and an open position;

a retractable pawl engageable with the latch bolt to selectively release the latch bolt;

a latch bolt release member including a controller which may be actuated in response to operation of a door handle and when the lock is unlocked to retract the pawl;

an electronic recognition member that generates an unlocking signal in response to a predetermined identification signal from a hands-off identification device;

a first actuator responsive to the unlocking signal to unlock the lock;

a second actuator responsive to the unlocking signal to retract the pawl and release the latch bolt.

7. A vehicle comprising the electrical lock of claim 1.

8. A vehicle comprising the electrical lock of claim 6.

9. An electrical lock for hands-off access to a vehicle having a door with a handle, said electrical lock having a locked state and an unlocked state, said electrical lock cooperating with a striker of said vehicle, said electrical lock comprising:

a forked latch bolt, said forked latch bolt having an open position and a closed position, said forked latch bolt holding said striker when in said closed position;

a pawl, said pawl blocking said latch bolt in said closed position and movable into a "retracted" position in which said latch bolt is no longer blocked;

an electronic recognition device, said electronic recognition device producing an unlocking signal when recognizing a first identification signal from a hands-off electronic identifying device;

a first latch bolt release mechanism comprising a control device which may be actuated in response to a user actuation of said handle of said door and which, acts on said pawl to bring said pawl into said "retracted" position when actuated in said unlocked state and has no effect on said pawl when actuated in said locked state;

an electromechanical locking/unlocking device including a first electric actuating device that places said latch bolt release mechanism in said unlocked state in response to said unlocking signal; and a second latch bolt release mechanism including a second electric actuating device that places said pawl into said "retracted" position in response to said unlocking signal.

10. The lock according to claim 9 wherein said second latch bolt release mechanism further comprises:

a motor; and a pusher connected to said motor, said pusher acting on said pawl.

11. The lock according to claim 10 further including a switch, said switch connecting a power supply to said motor, said switch closed in response to said unlocking signal.

12. The lock according to claim 10 wherein said second latch bolt release mechanism further comprises:

a motion control system; and a spindle, said spindle connected to said motor through said motion control system.

13. The lock according to claim 9 wherein said electronic recognition device is supplied power only upon a user actuation of said handle of said door.

14. The lock according to claim 13 further including a control system, said control system connecting a power supply to said electronic recognition device, said control system closing a power supply circuit upon said user actuation.

15. The lock according to claim 14 wherein said control system is a normally open microswitch.

16. The lock according to claim 9 wherein said first latch bolt release mechanism comprises a rod having an upper end and a lower end, said upper end having a projection pin that abuts said pawl, said rod activated by a user actuation of said handle.

17. The lock according to claim 9 wherein said electronic recognition device comprises:

a radio transceiver;

a means for determining a user identifier matching an authorized user identifier;

a signal generator.

18. An automatic lock assembly for a vehicle having a door with a handle, said automatic lock comprising a latch bolt, said latch bolt being movable between a closed position and an open position;

a retractable pawl selectively engageable with said latch bolt to release said latch bolt from said closed position into said open position;

a latch bolt release member having a locked state and an unlocked state, said latch bolt release member including a controller which retracts said pawl from said latch bolt when said handle is actuated in said unlocked state;

an electronic recognition member that generates an unlocking signal in response to a predetermined identification signal from a hands-off identification device;

a first actuator responsive to the unlocking signal to place said latch bolt release member in said unlocked state;

a second actuator responsive to said unlocking signal to retract said pawl and release said latch bolt from said closed position into said open position.

19. The automatic lock assembly according to claim 18 wherein said second actuator comprises:

a motor;

a motion control system connected to said motor;

a spindle, said spindle connected to said motor through said motion control system;

a pusher connected to said motor, said pusher acting on said pawl;

a switch, said switch connecting a power supply to said motor, said switch closed in response to said unlocking signal.

20. The automatic lock assembly according to claim 18 wherein said electronic recognition device is supplied power only upon a user actuation of said handle of said door.

* * * * *